United States Patent [19]

Merz, Johann et al.

[11] Patent Number: 4,772,190

[45] Date of Patent: Sep. 20, 1988

[54] VANE CELL PUMP HAVING RESILIENT SEALING MEANS BIASING THE PRESSURE PLATE

[75] Inventors: Merz, Johann, Schwäbisch Gmünd; Eckard Keicher, Bad Neuenstadt, both of Fed. Rep. of Germany

[73] Assignee: Zahnradfabrik Friedrichshafen, AG., Friedrichshafen, Fed. Rep. of Germany

[21] Appl. No.: 26,443

[22] PCT Filed: Jul. 17, 1986

[86] PCT No.: PCT/EP86/00421

§ 371 Date: Mar. 20, 1987

§ 102(e) Date: Mar. 20, 1987

[87] PCT Pub. No.: WO87/00587

PCT Pub. Date: Jan. 29, 1987

[30] Foreign Application Priority Data

Jul. 26, 1985 [WO] PCT Int'l Appl. ..... PCT/EP85/00375

[51] Int. Cl.[4] ..... F04C 2/00; F04C 15/00

[52] U.S. Cl. ..... 418/133; 418/135

[58] Field of Search ..... 418/133, 135, 132; 417/310, 300

[56] References Cited

U.S. PATENT DOCUMENTS

| | | | |
|---|---|---|---|
| 3,052,189 | 9/1962 | Head | 418/135 |
| 3,240,154 | 3/1966 | Robbins | 418/135 |
| 3,664,776 | 5/1972 | Mills et al. | 418/135 |
| 4,242,066 | 12/1980 | Hodgson | 418/132 |
| 4,373,871 | 2/1983 | Christ | 417/310 |
| 4,424,014 | 1/1984 | Anderson | 418/133 |

FOREIGN PATENT DOCUMENTS

| | | |
|---|---|---|
| 1528975 | 9/1969 | Fed. Rep. of Germany . |
| 2443720 | 4/1975 | Fed. Rep. of Germany . |
| 2913419 | 9/1980 | Fed. Rep. of Germany . |
| 2497880 | 7/1982 | France . |

*Primary Examiner*—John J. Vrablik
*Assistant Examiner*—Leonard P. Walnoha
*Attorney, Agent, or Firm*—Zalkind & Shuster

[57] ABSTRACT

A vane cell pump comprises a housing having a small bore at one end extending to a large bore at the other end. A drive shaft for a pump package, i.e., a rotor, vanes and cam ring in said large bore. The other end of the housing is closed by a pressure plate against which one radial face of the pump package rotates, and which pressure plate is bolted to the housing. Another pressure plate within the large bore is pressed against the opposite radial face of the pump package by being exposed to an outlet pressure chamber of the pump. The area of the outlet pressure chamber to which the latter pressure plate is exposed is demarcated by axial sealing elements surrounding the drive shaft and exerting a compression force between a housing wall and the latter pressure plate. The construction effects a tight tolerance between relatively moving parts at all times including the start of pump operation.

1 Claim, 1 Drawing Sheet

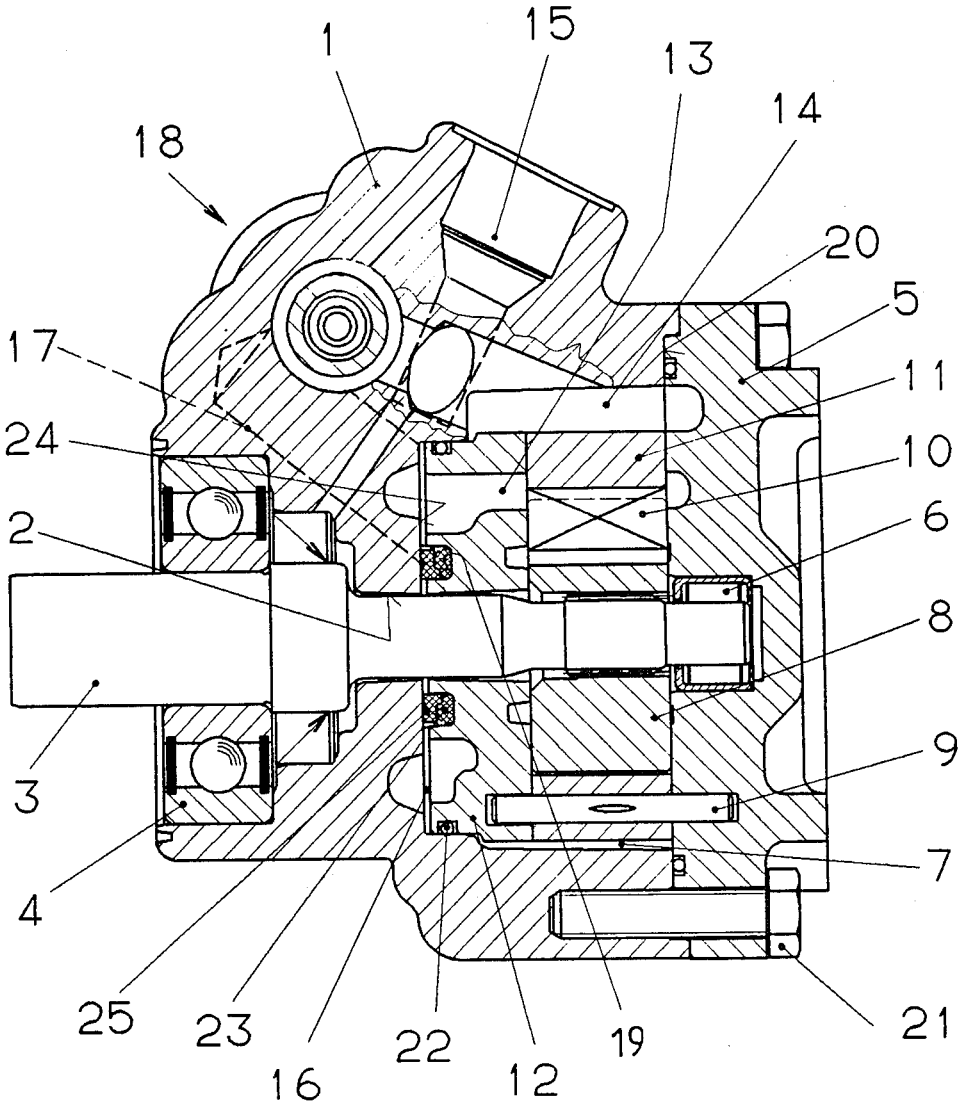
1
15
13
14
18
20
5
17
11
24
10
2
6
8
3
9
7
4
25
23
16
22
12
19
21

VANE CELL PUMP HAVING RESILIENT SEALING MEANS BIASING THE PRESSURE PLATE

BACKGROUND OF THE INVENTION

A known pump of the vane type is shown in the U.S. Pat. No. 4,373,871 of Feb. 15, 1983, wherein a pressure plate faces the inlet side of the drive shaft exposed to inlet pressure. Such pressure plate is contiguous to a pump package comprising a rotor, having valves encompassed by a cam ring. The pump package is contiguous with an additional pressure plate within the pump housing which closes the pump housing and is sealed therein by abutment with a sealing ring carried annularly within the housing. The pump package is thus sandwiched between a pressure plate on the inlet side of the pump and a pressure plate at the outlet side to minimize flow losses due to unavoidable production tolerances. In order to maintain a close relationship a spring is used to startup of the pump when there is insufficient outlet pressure. The pressure plate at the outlet side of the pump package is provided with a radial sealing ring, which is held in a relatively complex sealing support assembly around a drive shaft bearing. The sealing assembly effects compensation for larger axial sealing tolerances.

BRIEF DESCRIPTION OF THE INVENTION

In the present invention, the pressure plate at the inlet side of the pump package is firmly fixed axially by being bolted to the pump housing. Such pressure plate can be manufactured with closer tolerances in order that the opposed pressure plate at the outlet side of the pump package and the housing can have at least one axially resilient sealing ring acting thereon and which sealing ring limits an area around the drive shaft exposed to outlet pressure. Such area is part of the gap or space between the housing wall and the outlet pressure plate which effects a pressure chamber. In view of the close tolerances involved, the sealing ring can achieve an additional function in dispensing with separate pressure springs acting on a pressure plate as in the prior art. There is a further advantage in that an axially effective sealing ring coacts with a resilient or elastic ring so that the sealing ring acting between the outer side of the pressure plate and a wall surface of the housing will not be forced into the gap around the drive shaft.

A detailed description now follows in conjunction with the drawing which shows a longitudinal section through a vane cell pump incorporating the invention.

Referring to the drawing, a drive shaft 3 is disposed in a pump housing 1 through a small bore 2. Drive shaft 3 is supported in an anti-friction bearing 4 in the housing, and in anti-friction bearing 6 in a pressure plate 5. Pressure plate 5 closes a large housing bore 7 and also serves as a cover for the housing. The drive shaft carries a rotor 8 splined thereto. Rotor 8 has radial slits which hold radially slidable vanes 10 within a cam ring 11. Pressure plate 12 at one side of the small bore 2 is contiguous to a pump package consisting of the rotor, vanes and cam ring. Pressure plate 5, cam ring 11 and pressure plate 12 are aligned by means of pins 9.

Pressure plate 12 has recesses with pressure flow receiving channels 13. The pressure zone of the pump is in the region of channels 13. Flow chambers, not apparent in the drawing, between vanes 10, rotor 8 and cam ring 11 communicate with a suction inlet bore 15 which will be understood to connect to a tank to provide flow to an inlet chamber 14 of partial ring shape. Pressure oil conveyed by vanes 10 to the pressure side of the pump package communicates via pressure channels 13 and a narrow pressure gap or chamber 16 to an outlet channel 17. Outlet channel 17 connects by an outlet bore (not shown) with a consumer, e.g., a hydraulic steering system. Upon start up of the pump, flow pressure responsive to the consumer demand builds up in the narrow pressure chamber 16 downstream of pressure plate 12 and such pressure flow acts against pressure plate 12 to maintain contiguity with the pump package components 8, 10 and 11, pressing the pump package against the opposite pressure plate 5 which is bolted to the housing, as shown. Thus, internal leakage losses are reduced to a minimum between the contiguous components.

Between suction pump 15 and outlet pressure channel 17, a flow regulating valve 18 is disposed transversely of the axis of the drive shaft. Increasing rpm of the drive shaft regulates the pump so that excess pressure flow is bypassed into suction pump 15. Such arrangements are generally known. Pressure plate 5 which closes the large bore 7 is, as stated, in fixed contact with the outer wall surface 20 of housing 1, being bolted to housing 1 by bolts 21. By the axially fixed securement of pressure plate 5, tight tolerances are maintained. Accordingly, the size of pressure chamber 16 effective at pressure plate 12 in surface area may be controlled by a circumferential sealing ring 22 which seals off the outer periphery of the pressure chamber. An axial sealing ring 23 inserted into a surface groove 19 can seal the outlet pressure chamber from the shaft by sealing contact with radial housing surface 24. The axial sealing ring 23 in pressure plate 12 before startup maintains the plate tightly against pump package 8, 10 and 11. This effect puts sealing pressure on pressure plate 5 through the contiguous members, such as the two pressure plates and the pump package. Accordingly, the pump has a perfect starting condition.

It is of advantage to support the axial sealing ring 23 by the compressible ring 25 made of synthetic material. Thus, in the event of pressure on pressure plate 12, a squeezing of the axial sealing ring 23 into the gap between housing surface 24 of the pressure plate in the direction of drive shaft 3 is avoided.

We claim:

1. In a vane cell pump of the kind having a housing (1) with a small axial bore (2) leading to a coaxial large bore (7) and a drive shaft (3) extending within said bores;

a pressure plate (12) adjacent an interior wall (24) of said housing within said large bore movable against a pump package comprising a rotor (8), vanes (10), cam ring (11), and through which pressure plate the drive shaft extends;

wherein the large bore is closed by a pressure plate (5) effecting a housing cover against which the pump package rotates sealingly during operation;

wherein the drive shaft has support in the latter pressure plate;

the improvement wherein said latter pressure plate (5) is a closure for the large bore (7) and is pressed axially against an end wall (2) of the housing (1) being bolted thereto;

and wherein between the first mentioned pressure plate (12) and the housing an axially resilient sealing ring (23) compressively maintains said pressure plate (12) against said pump package; a pressure chamber (16) including means whereby said pressure chamber is exposed to outlet pressure, said last mentioned pressure plate and an interior wall (24) of said large bore forming walls of said pressure chamber for effecting outlet pressure on said last mentioned pressure plate and effecting a gap therebetween through which said drive shaft passes;

an elastic sealing ring (25) urging said axially resilient sealing ring (23) towards said last mentioned pressure plate;

said sealing rings being carried in said last mentioned pressure plate surrounding said drive shaft.

* * * * *